US007219389B2

(12) United States Patent
Hafling et al.

(10) Patent No.: US 7,219,389 B2
(45) Date of Patent: May 22, 2007

(54) NOZZLE ASSEMBLY HOUSING FOR VACUUM CLEANER

(75) Inventors: Danielle M. Hafling, Lancaster, KY (US); Eric E. Muhlenkamp, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 468 days.

(21) Appl. No.: 10/897,615

(22) Filed: Jul. 23, 2004

(65) Prior Publication Data

US 2005/0022339 A1 Feb. 3, 2005

Related U.S. Application Data

(60) Provisional application No. 60/490,634, filed on Jul. 28, 2003.

(51) Int. Cl.
*A47L 5/10* (2006.01)

(52) U.S. Cl. ..... 15/391; 15/339

(58) Field of Classification Search ..... None
See application file for complete search history.

(56) References Cited

U.S. PATENT DOCUMENTS 3,916,476 A 11/1975 Johnson et al.
5,632,060 A 5/1997 Steinberg et al.
6,029,313 A * 2/2000 O'Dea et al. ..... 15/391

* cited by examiner

*Primary Examiner*—David Redding
(74) *Attorney, Agent, or Firm*—King & Schickli, PLLC

(57) ABSTRACT

A nozzle assembly housing includes a first wall, a second wall and an access opening in those walls. A locking tab receiver is provided on the first wall adjacent the access opening. A notch is provided on the second wall adjacent the access opening. Finally, a separate, removable panel closes the access opening. That panel includes a locking tab on a first edge that engages the locking tab receiver and a hinge lug on a second edge that is pivotally received in the notch.

17 Claims, 7 Drawing Sheets

NOZZLE ASSEMBLY HOUSING FOR VACUUM CLEANER

This application claims the benefit of U.S. Patent Application Ser. No. 60/490,634 filed on Jul. 28, 2003.

TECHNICAL FIELD

The present invention relates generally to the floor care equipment field and, more particularly, to a nozzle assembly housing for a vacuum cleaner or the like incorporating a hinged removable panel and to a related method of securing a removable panel to a housing of a vacuum cleaner.

BACKGROUND OF THE INVENTION

Upright, canister and hand-held vacuum cleaners have long been known in the art. Many such vacuum cleaners incorporate one or more rotary agitators. These rotary agitators are equipped with cleaning structures including but not limited to beater bars, wipers, brushes and bristle tufts. As the agitators are rotated relative to the floor being cleaned, these cleaning structures function to beat dirt and debris from the nap of an underlying carpet.

Whether driven by the motor of the suction fan generator or an independent agitator drive motor, the linkage between the motor and the agitators in many vacuum cleaners is made by means of a belt. While advances in belt technology have made significant gains in service life, belts still become worn over time and require replacement. Further, in the event of an agitator jam, a vacuum cleaner is typically designed to sacrifice a relatively inexpensive belt in order to save the agitator drive motor. Thus, most vacuum cleaner operators will be faced with a belt change at least once during the operating life of a vacuum cleaner.

In many vacuum cleaners, it is difficult and time consuming to service the agitator drive belt. Often, one must remove the top or bottom of the agitator housing in order to access the belt. This can be difficult, time consuming and also very inconvenient. Further, many individuals are not mechanically inclined and the prospect of such a task leads them to take their vacuum cleaner to professional vacuum cleaner service personnel. This is often a time consuming and frustrating situation that creates an unfavorable impression upon the consumer.

In an effort to address this problem, efforts have been made in the past to simplify agitator drive belt service. For example, U.S. Pat. No. 3,916,476 to Johnson et al. discloses a vacuum cleaner incorporating an access door that is pivotally attached to the main housing by means of a hinge. When opened, the door allows access to the agitator drive belt for servicing thereof.

While very useful and effective for its intended purpose, some individuals find the open access door to be an annoyance or hindrance to belt changing. The present invention addresses this problem by providing a pivoting access door or panel that is separate and free from the main housing of the nozzle assembly. Thus, after pivotally opening the access door, it may be set to the side thereby eliminating any potential for the access panel to get in the way of the belt changing process.

SUMMARY OF THE INVENTION

In accordance with the purposes of the present invention as described herein, a nozzle assembly housing is provided. That nozzle assembly housing includes a first wall, a second wall and an access opening in the first and second walls. A locking tab receiver is provided on the first wall adjacent the access opening. A notch is provided on the second wall adjacent the access opening. Additionally, a removable panel is provided for closing the access opening. The panel includes a locking tab on a first edge mating with the locking tab receiver and a hinge lug on a second edge received in the notch so as to allow pivotal movement of the panel relative to the second wall of the housing.

More specifically describing the invention, a first shoulder is provided on the second wall adjacent a first end of the notch. Additionally, a second shoulder is provided on the second wall adjacent a second end of the notch. Together, the shoulders engage a rear face of the removable panel. Still further, a third and fourth shoulder may be provided on the first and second walls for engaging a rear face of the removable panel. These shoulders function to hold the panel flush with the first and second walls when the panel is properly seated to close the opening.

The removable panel includes a first guide and a second guide. Both the first and second guides may be substantially L-shaped. When the removable panel is seated to close the access opening, the first guide engages the second wall and the third shoulder. The second guide engages the second wall and the fourth shoulder. Each of the first and second guides also includes a projecting tip engaging the second wall. The projecting tips are rounded.

Still further, the removable panel also carries a belt guard. In addition, the removable panel includes a finger grip adjacent the locking tab. This finger grip allows the operator to conveniently engage and disengage the locking tab from the locking tab receiver.

In accordance with still another aspect of the present invention, a vacuum cleaner is provided incorporating the nozzle assembly housing of the present invention. Further, a method is provided of securing a removable panel to a housing of a vacuum cleaner. The method includes inserting a hinge lug on a first portion of the removable panel into a cooperating notch on the housing, pivoting the panel in an arc about the hinge lug until a locking tab on a second portion of the panel is adjacent a locking tab receiver on the housing and engaging the locking tab with the locking tab receiver. The engaging step includes depressing the panel adjacent the second portion and pivoting the panel in an arc after depressing.

A method of removing a separate, removable panel from the walls of a vacuum cleaner housing is also disclosed. That method includes the steps of (a) depressing a portion of the panel to release a locking tab on the panel from a locking tab receiver on one of the walls; (b) pivoting the panel on a hinge formed between the panel and another of the walls; and (c) removing the panel from the walls. The present invention provides the operator of the vacuum cleaner with the convenience and operating simplicity of a hinged panel for providing access to an agitator drive belt in the housing of the nozzle assembly. Advantageously, this is done while also avoiding any potential inconvenience that might be related to such a panel attached to the nozzle assembly. Specifically, the separate, fully removable hinged panel of the present invention may be positioned at a location remote from the nozzle assembly where it cannot possibly interfere with the belt changing operation.

In the following description there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
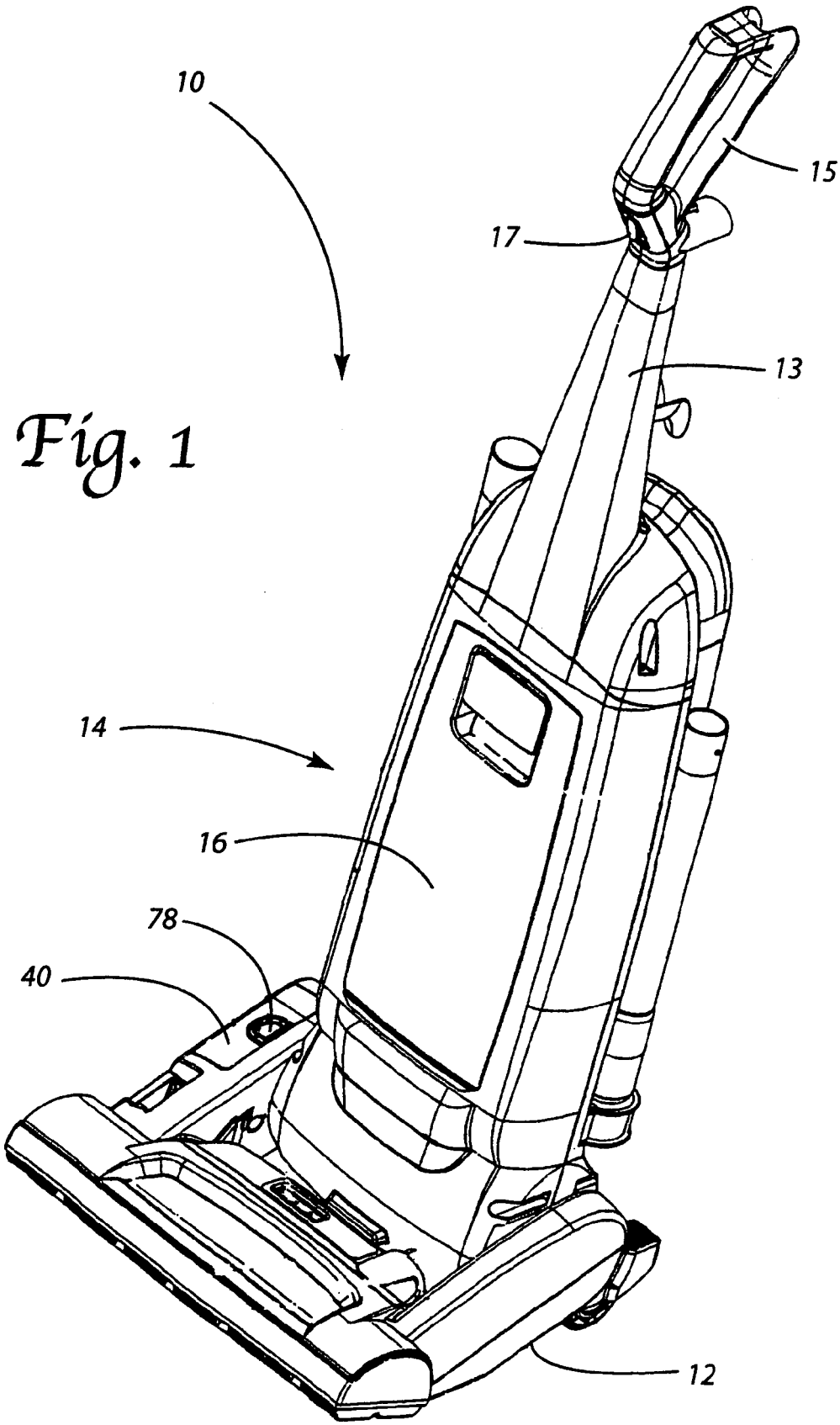
FIG. 1 is a perspective view of a vacuum cleaner incorporating the nozzle assembly housing of the present invention.

Reference is now made to FIG. 1 illustrating an upright vacuum cleaner 10 incorporating the nozzle assembly housing 12 of the present invention.

As illustrated, the vacuum cleaner 10 incorporates a canister assembly housing 14 that is pivotally connected to the nozzle assembly housing 12. The canister assembly housing 14 carries a control handle 13, a hand grip 15 and an on/off actuator switch 17. The canister assembly housing 14 also includes a cavity for holding a dirt cup 16 for collecting dirt and debris. The dirt cup 16 may or may not include structures to produce cyclonic airflow in order to assist in separation of dirt from the airstream as it passes through the vacuum cleaner 10. In the alternative, the cavity may simply house a state-of-the-art bag filter behind an access door or cover instead of a dirt cup.

The vacuum cleaner 10 also includes a suction generator (not shown) that is mounted in an internal chamber in the canister assembly housing 14. Of course, in an alternative embodiment, that suction generator could be housed in the nozzle assembly housing 12 if desired. In the illustrated embodiment, a drive belt 20 connects the drive shaft (not shown) of the suction generator motor with a step down pulley 22 that is connected by a second belt to one or more rotary agitators provided on the nozzle assembly housing.

Figure 2:
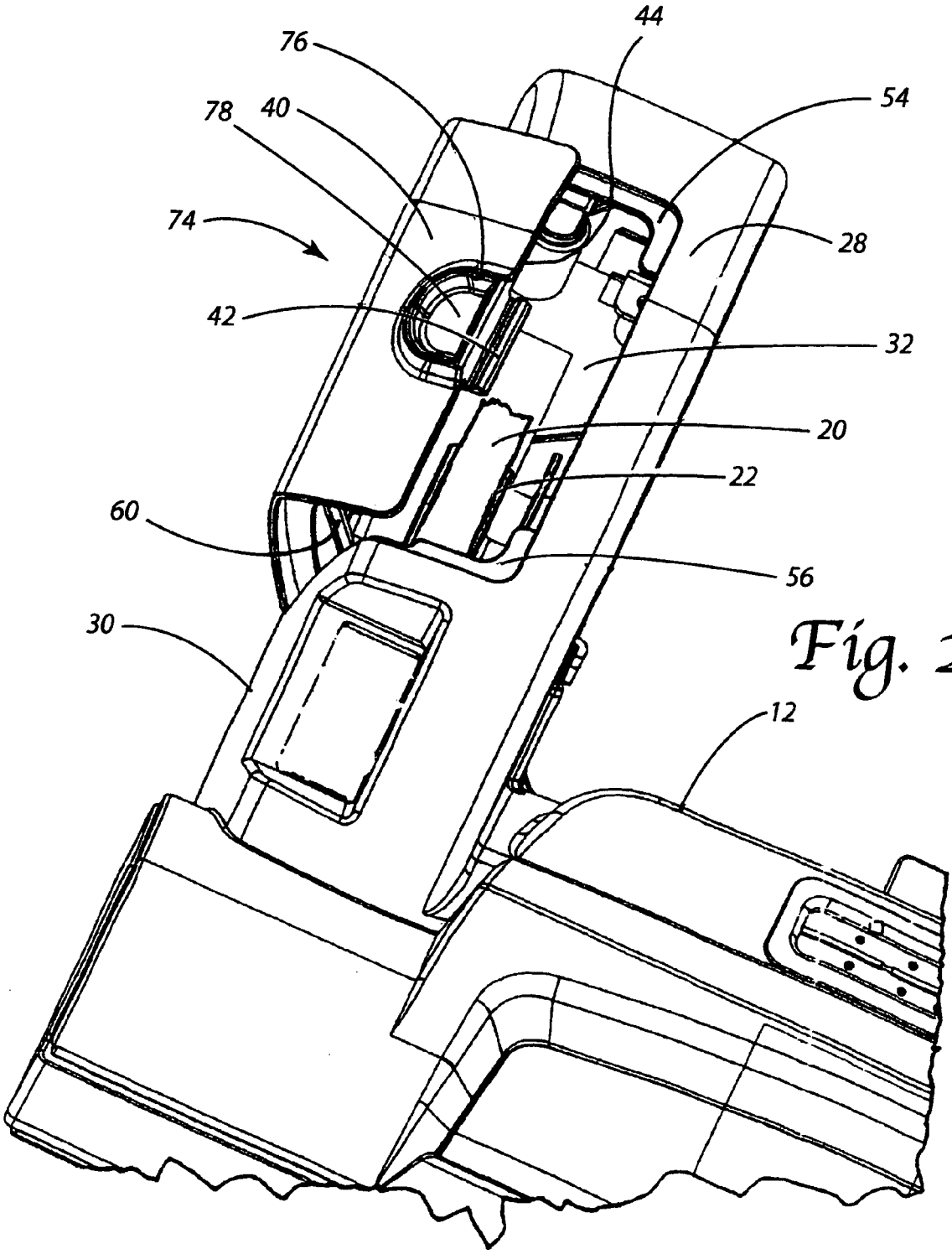
FIG. 2 is a detailed fragmentary and perspective view showing the separate, removable panel hinged into a slightly open position to allow access to the agitator drive belt on the underlying pulley held in the nozzle assembly housing.
Figure 5:
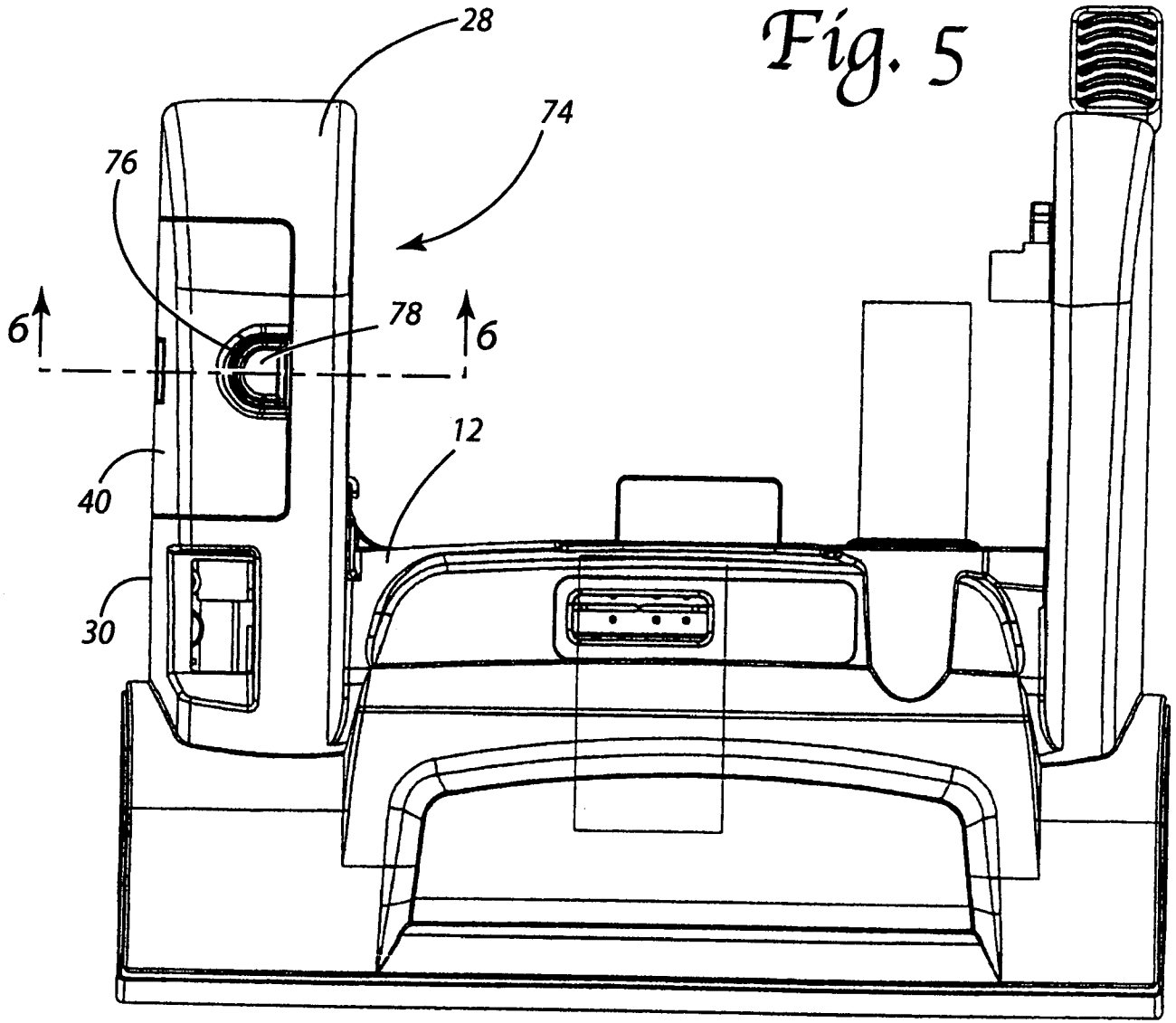
FIG. 5 is a top plan view of the housing of the nozzle assembly with the panel covering the access opening and engaging the main body of the housing.
Figure 6:
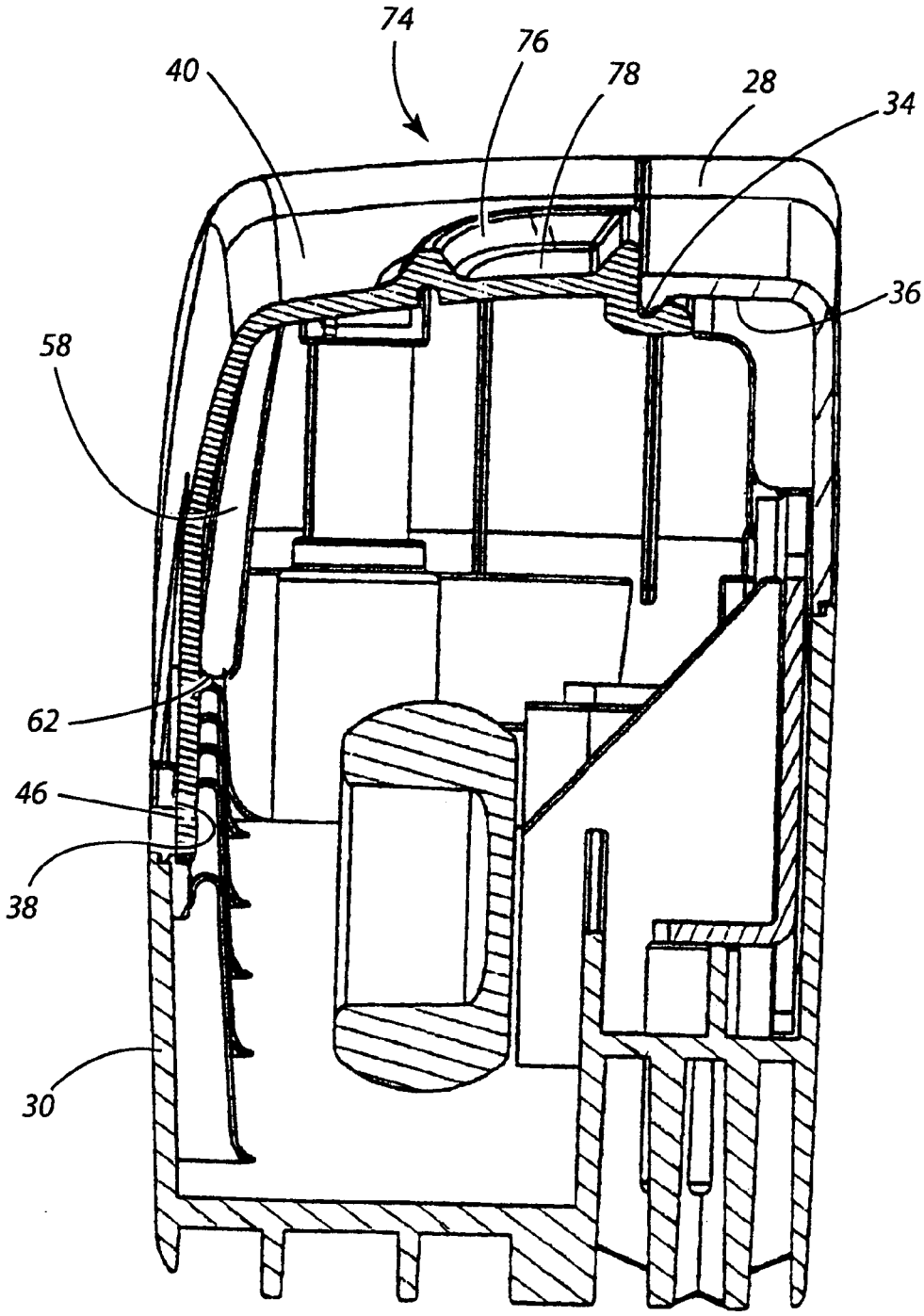
FIG. 6 is a cross-sectional view through line 6—6 of FIG. 5.
Figure 7:
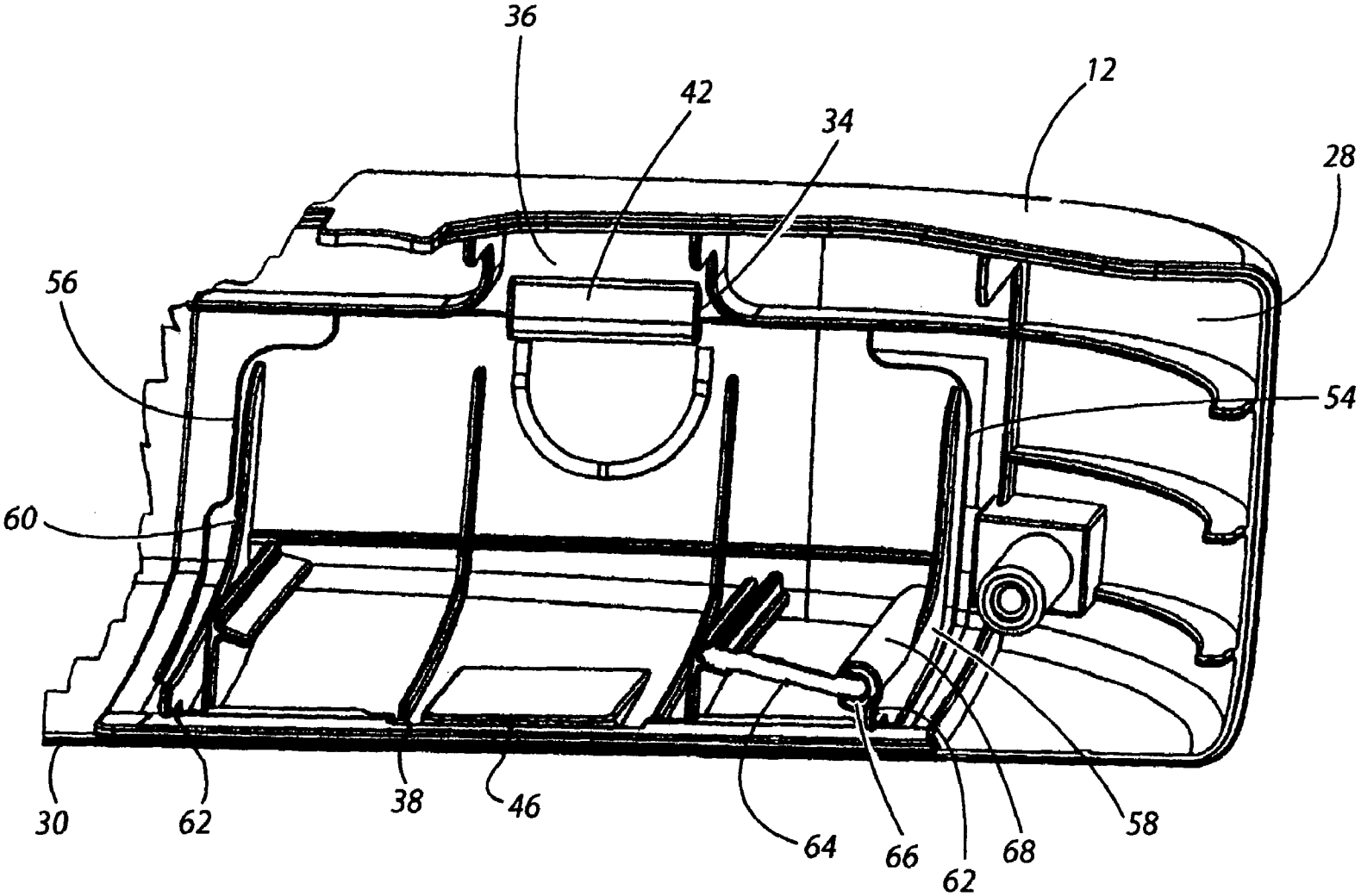
FIG. 7 is an inside elevational and fragmentary view showing how the locking tab, hinge lug and guides on the removable panel engage the nozzle assembly housing.

As best illustrated in FIGS. 2, 5 and 6, the nozzle assembly housing 12 includes a first wall 28 and a second wall 30. An access opening 32 is provided in the first and second walls 28, 30. Additionally, a locking tab receiver 34 is provided on the inner surface 36 of the first wall adjacent the access opening 32. Similarly, a notch or slot 38 is provided on the second wall 30 adjacent the access opening 32.

As best illustrated in FIGS. 2–7, a separate, removable panel 40 closes the access opening 32 in the nozzle assembly housing 12. The panel 40 includes a projecting locking tab 42 on the first edge 44 of a first portion and a projecting hinge lug 46 on a second edge 48 of a second portion. When the panel 40 is properly seated on the first and second walls 28, 30 of the nozzle assembly housing 12, the locking tab 42 engages the locking tab receiver 34 and the hinge lug 46 engages the notch 38.

Figure 3:
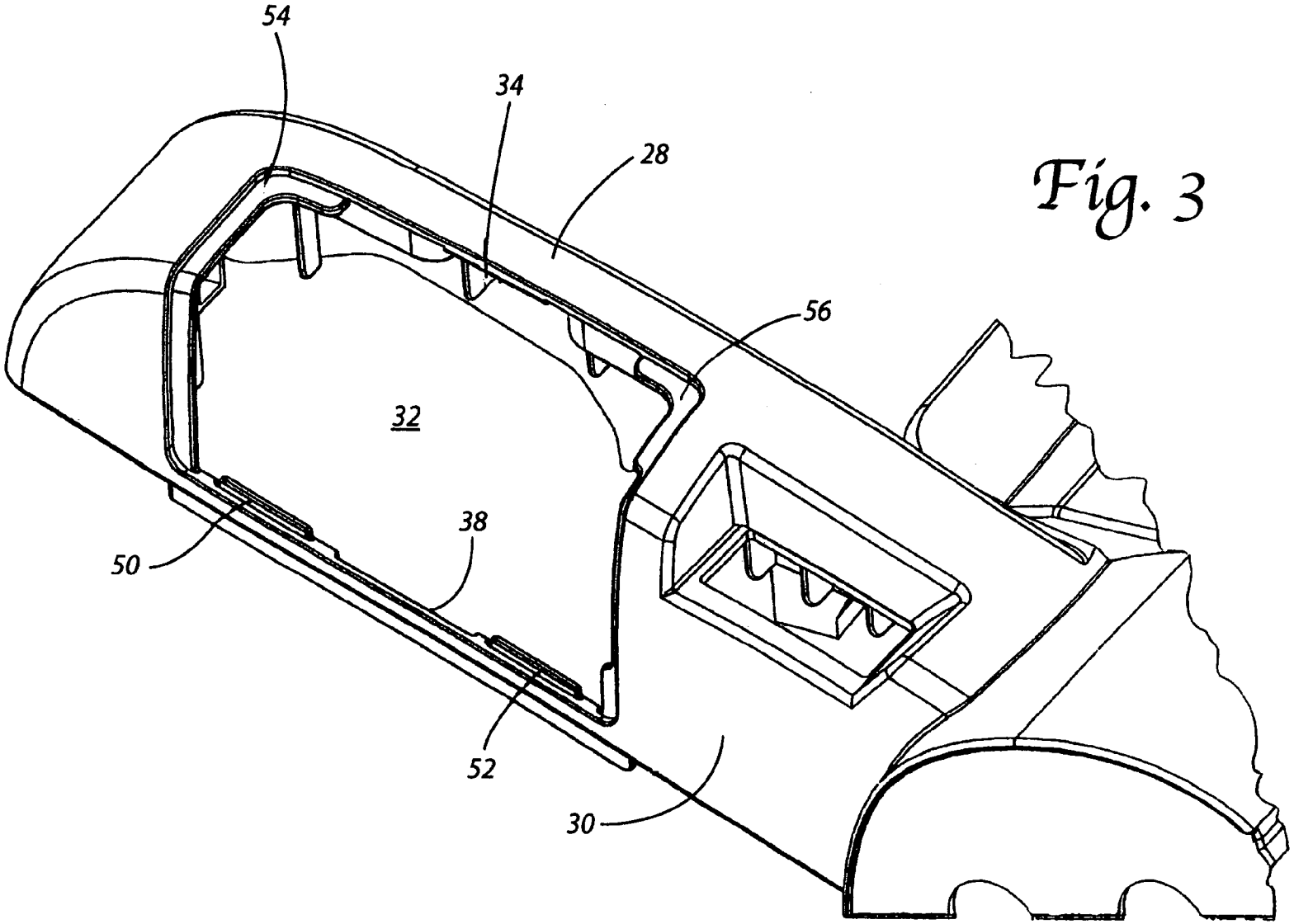
FIG. 3 is a detailed, fragmentary perspective view showing the shoulders on the walls of the housing around the access opening.

As best illustrated in FIGS. 2 and 3, the first and second walls 28, 30 of the nozzle assembly housing 12 include a series of shoulders that engage and back the panel 40 so that the panel is held flush in those walls. More specifically, a first shoulder 50 is provided on the second wall 30 adjacent a first end of the notch 38. A second shoulder 52 is provided on the second wall 30 adjacent a second end of the notch 38. Third and fourth shoulders 54, 56 are provided on the first and second walls 28, 30.

Figure 4:
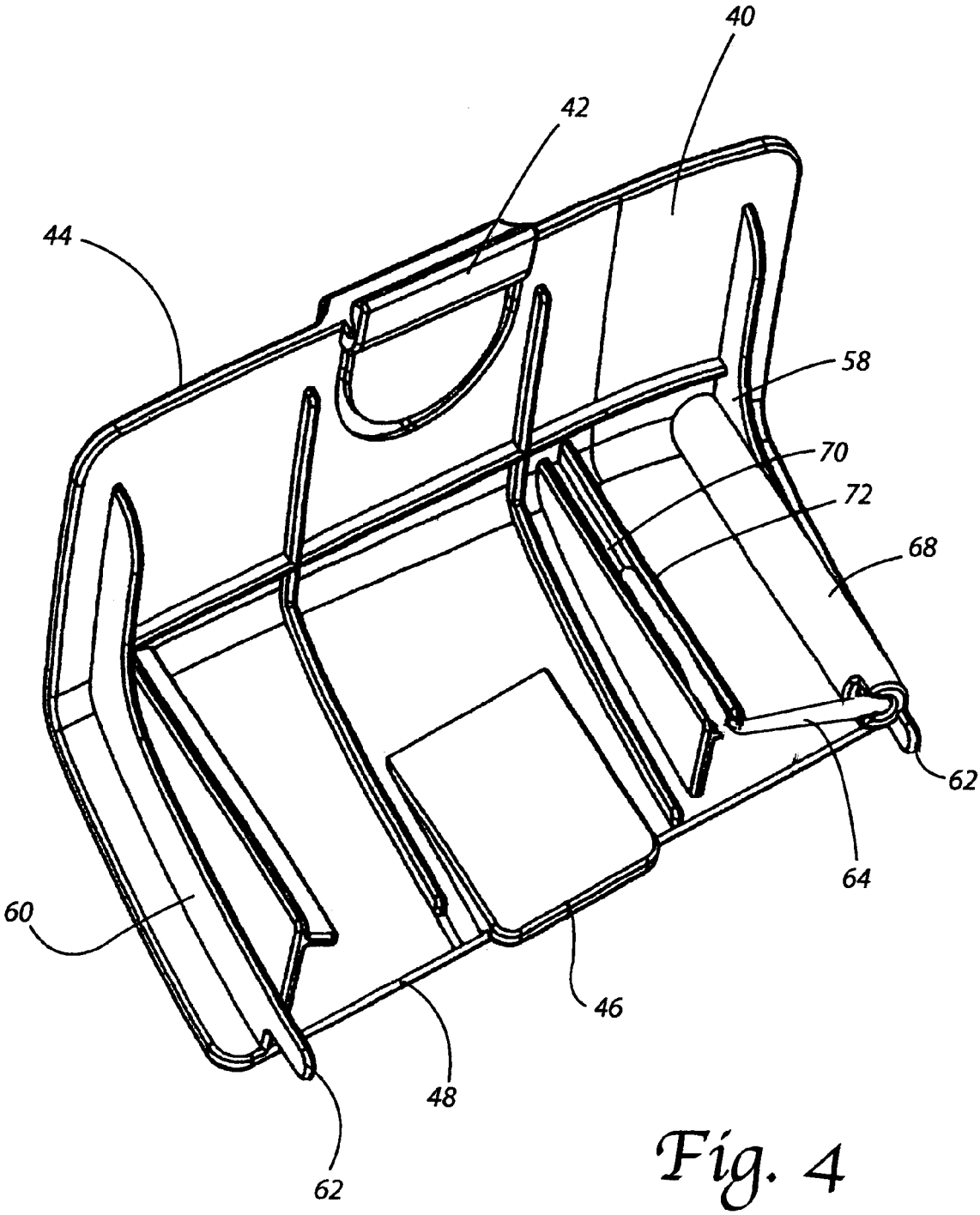
FIG. 4 is a detailed inside perspective view of the separate, removable panel.

As best illustrated in FIG. 4, the panel 40 includes a first guide 58 and a second guide 60. Each of the guides 58, 60 is substantially L-shaped. As the panel 40 is properly seated in the first and second walls 28, 30 to close the access opening 32, the first guide 58 is adjacent to and engages the second wall 30 and the third shoulder 54. Simultaneously, the second guide 60 is adjacent to and engages the second wall 30 and the fourth shoulder 56.

As illustrated, each of the first and second guides 58, 60 includes a projecting tip 62 that is rounded. The separate, removable panel 40 also carries a belt guard, generally designated by reference numeral 64. As illustrated, the belt guard 64 comprises a substantially U-shaped metal rod having a first end that is received in an aperture 66 in the end of the reinforcing rib 68 and a second end abutting a ledge or channel 70 provided on a second reinforcing rib 72. The belt guard 64 ensures that a damaged drive belt 20 does not contact and accidentally damage the panel 40 which is typically constructed from relatively lightweight plastic material.

As best illustrated in FIGS. 2 and 5, the panel 40 also includes a finger grip 74 adjacent the locking tab 42. As illustrated, the finger grip 74 comprises a raised ridge 76 defining a substantially D-shaped recess or cavity 78. This finger grip 74 is useful when securing and removing the panel 40 as described in greater detail below.

During the life of the vacuum cleaner 10, it may become necessary to service the drive belt 20 that transmits rotary motion to the agitator or agitators of the vacuum cleaner 10. This may be done by removing the panel 40. Toward this end, one engages a thumb or finger in the D-shaped cavity 78 of the finger grip 74 and depresses the panel 40. This action functions to release the locking tab 42 from the locking tab receiver or lip 34. The operator continues to depress the panel 40 as the panel is pivoted in an arc about the longitudinal axis of the hinge lug 46 that at this time is received in the notch 38 in the second wall 30 (see action arrow A in FIG. 2). The guides 58 and 60 and the rounded tips 62 thereof help to ensure smooth pivoting motion of the panel 40 relative to the wall 30.

Once the locking tab 42 clears the first wall 28, it is no longer necessary to depress the panel 40. Consequently, the panel 40 may then simply be lifted so as to withdraw the hinge lug 46 from the notch 38. The panel 40 is then completely free of the walls 28, 30 of the housing 12 and it may then be positioned at any remote location so as to not possibly interfere in any way with the servicing of the drive belt 20.

After servicing the drive belt 20, the panel 40 may again be seated on the walls 28, 30 in order to close the access opening 32 in the housing 12. This is done by first inserting the hinge lug 46 in the notch 38. Next, the panel 40 is pivoted in an arc about the hinge lug 46 as the operator depresses a portion of the panel 40 by engaging the D-shaped cavity 78 of the finger grip 74. This combined action allows the locking tab 42 to clear the edge of the first wall 28 and engage the locking tab receiver 34. The pivoting movement of the panel 40 is halted when the locking tab 42 is fully engaged with the locking tab receiver or lip 34 and the first edge 44 of the panel is received against the first wall 28. At this point the operator releases the pressure provided at the finger grip 74 and the panel 40 is fully and properly seated on the walls 28, 30 to close the access opening 32. Advantageously, the locking tab 42 and the projecting hinge lug 46 function with the projecting tips 62 of the guides 58 and 60 to secure the panel 40 in the seated position. Simultaneously, the shoulders 50, 52, 54 and 56 function together to form a recessed shelf for receiving the panel 40 and holding the panel flush with the walls 28, 30 so as to provide an aesthetically pleasing appearance.

The foregoing description of the preferred embodiment of this invention has been presented for purposes of illustration and description. It is not intended to be exhaustive or to limit the invention to the precise form disclosed. Obvious modifications or variations are possible in light of the above teachings. For example, the nozzle assembly housing 12 of the present invention is illustrated as being part of an upright vacuum cleaner 10. It should be appreciated, however, that the nozzle assembly housing 12 could just as easily be part of a power nozzle of a canister vacuum cleaner and/or the rotary agitator equipped nozzle portion of a hand-held vacuum cleaner. Further, while the locking tab 42 is provided on the panel 40 and the locking tab receiver 34 is provided on the first wall 28 in the illustrated embodiment, the positions of the tab and receiver could just as easily be reversed. The present invention and claims are considered to be sufficiently broad to cover such an alternative arrangement. In addition, while the access opening and panel are described with regard to the servicing of an agitator drive belt, the housing structure could just as easily be associated with the servicing of a different belt or other structural feature of a vacuum cleaner that might require periodic servicing.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. A nozzle assembly housing, comprising:

a first wall;

a second wall connected to said first wall, said first and second walls forming at least a part of said housing, an access opening in said first wall and said second wall providing access to a motor-driven belt;

a locking tab receiver on said first wall adjacent said access opening;

a notch on said second wall adjacent said access opening;

a separate, removable panel closing said access opening, said panel including a locking tab on a first edge engaging said locking tab receiver and a hinge lug on a second edge pivotally received in said notch.

2. The nozzle assembly housing of claim 1 further including a first shoulder on said second wall adjacent a first end of said notch and a second shoulder on said second wall adjacent a second end of said notch, said first and second shoulders engaging a rear face of said removable panel.

3. The nozzle assembly housing of claim 2, further including a third shoulder and a fourth shoulder on said first wall and said second wall engaging a rear face of said removable panel.

4. The nozzle assembly housing of claim 3, wherein said removable panel includes a first guide and a second guide.

5. The nozzle assembly housing of claim 4, wherein said first guide and said second guide are substantially L-shaped.

6. The nozzle assembly housing of claim 5, wherein said first guide engages said second wall and said third shoulder.

7. The nozzle assembly housing of claim 6, wherein said second guide engages said second wall and said fourth shoulder.

8. The nozzle assembly housing of claim 6, wherein each of said first and second guides includes a projecting tip engaging said second wall.

9. The nozzle assembly housing of claim 8, wherein said projecting tips are rounded.

10. The nozzle assembly housing of claim 9, wherein said removable panel carries a belt guard.

11. The nozzle assembly housing of claim 10, wherein said removable panel includes a finger grip adjacent said locking tab.

12. The nozzle assembly of claim 1 wherein said locking tab receiver is provided on said panel instead of said first wall and said locking tab is provided on said first wall instead of said panel.

13. A vacuum cleaner incorporating said nozzle assembly housing of claim 1.

14. A method of securing the separate, removable panel to walls of the nozzle assembly housing of claim 1 of a vacuum cleaner, comprising:

inserting the hinge lug on a first portion of said removable panel into the cooperating notch on said housing;

pivoting said panel in an arc about said hinge lug until the locking tab on a second portion of said panel is adjacent the locking tab receiver on said housing; and engaging the locking tab with the locking tab receiver.

15. The method of claim 13 wherein said engaging includes depressing said panel adjacent said second portion.

16. The method of claim 14, wherein said engaging also includes further pivoting said panel in said arc after depressing.

17. A method of removing the separate, removable panel from walls of the nozzle assembly housing of claim 1 of a vacuum cleaner housing, comprising:

depressing a portion of the panel to release the locking tab on the panel from the locking tab receiver on one of said walls;

pivoting said panel on a hinge formed between said panel and another of said walls; and removing said panel from said walls.

* * * * *